US012392122B2

(12) United States Patent
Pegoraro

(10) Patent No.: US 12,392,122 B2
(45) Date of Patent: Aug. 19, 2025

(54) MODULAR ELEMENT FOR MAKING UNDERGROUND STRUCTURES FOR BASINS DESIGNED TO MANAGE METEORIC WATERS OR UNDERGROUND STRUCTURES FOR RETAINING SOIL

(71) Applicant: Geoplast SpA, Grantorto (IT)

(72) Inventor: Mirco Pegoraro, Grantorto (IT)

( * ) Notice: Subject to any disclaimer, the term of this patent is extended or adjusted under 35 U.S.C. 154(b) by 132 days.

(21) Appl. No.: 18/000,980

(22) PCT Filed: Jun. 10, 2021

(86) PCT No.: PCT/IB2021/055092
§ 371 (c)(1),
(2) Date: Dec. 7, 2022

(87) PCT Pub. No.: WO2021/255588
PCT Pub. Date: Dec. 23, 2021

(65) Prior Publication Data

US 2023/0220658 A1 Jul. 13, 2023

(30) Foreign Application Priority Data

Jun. 15, 2020 (IT) ..... 102020000014176

(51) Int. Cl.
*E03F 1/00* (2006.01)
*E02B 11/00* (2006.01)
*E03F 5/06* (2006.01)

(52) U.S. Cl.
CPC ..... *E03F 1/005* (2013.01); *E02B 11/005* (2013.01); *E03F 5/06* (2013.01)

(58) Field of Classification Search
CPC ..... E03F 1/005; E03F 1/002; E02B 11/005
See application file for complete search history.

(56) References Cited

U.S. PATENT DOCUMENTS

| | | | | |
|---|---|---|---|---|
| 9,506,235 | B2 * | 11/2016 | Adams | E03F 1/005 |
| 9,957,987 | B2 * | 5/2018 | Wandkowski | E02B 11/00 |
| 2012/0255624 | A1 * | 10/2012 | Canney | E02B 11/005 137/315.01 |

FOREIGN PATENT DOCUMENTS

| | | |
|---|---|---|
| AU | 2010305511 | 8/2015 |
| DE | 102012100552 | 7/2013 |
| JP | 2002309659 | 10/2002 |
| JP | 2017095971 | 6/2017 |

* cited by examiner

*Primary Examiner* — Carib A Oquendo
(74) *Attorney, Agent, or Firm* — Themis Law

(57) ABSTRACT

A modular element or semi-module for making underground structures of basins for the management of meteoric waters or for retaining soil includes a substantially planar base portion and one or more pillars rising from the base portion. Each pillar is hollow and has a first external wall defining at least one internal cavity, inside the cavity there being an internal tubular stiffening wall that is spaced from the external wall and has a prismatic shape or a shape substantially corresponding to that of the external wall.

12 Claims, 5 Drawing Sheets

MODULAR ELEMENT FOR MAKING UNDERGROUND STRUCTURES FOR BASINS DESIGNED TO MANAGE METEORIC WATERS OR UNDERGROUND STRUCTURES FOR RETAINING SOIL

This patent relates to underground tanks and structures for the management of rainwater or to retain soil and in particular concerns a new improved modular element for creating underground structures in underground basins for the management of rainwater or to retain soil.

Underground basins are already known in the prior art, that is, rainwater collection tanks constructed under the urban pavement, or any public or private surface in general, having the purpose of collecting rainwater, thus preventing flooding due to the increase of urbanized areas and also to enable the sustainable management of the water collected, which can be advantageously used for irrigation, for example.

These tanks have internal structures to bear the loads above.

The prior art comprises modular elements in plastic material which are placed next to and constrained to each other inside the tank, in order to create the load-bearing structure, while ensuring a sufficient percentage of empty volume to contain rainwater.

These modular elements are substantially parallelepiped three-dimensional bodies, formed by a substantially flat base from which internally hollow truncated pyramidal pillars rise to form an overall volume with a high percentage of hollow space.

These modular elements are placed inside the tank and connected to each other. Upper grids are then positioned on each element to enable the passage of water and also create a walkable surface useful in the installation phase and for the distribution of the loads acting on it.

In addition, lateral load distribution grids are positioned and suitably shaped for the possible connection with pipes.

In order to reduce the overall dimensions during storage and transport, each of said modular elements is in fact a semi-module, sized and configured to be coupled with an identical element superimposed symmetrically to make up a whole module.

Since said pillars have a truncated pyramid shape, the modular elements can be stacked together during the transport and storage phases.

The underground basins thus created also comprise inspection shafts which must be installed on the upper pedestrian surface of said modular elements connecting the pavement with the basin interior.

It is not always easy to obtain space for the water intake pipes in the basin or for the basin inspection shafts themselves.

To install such shafts these modular elements must be pre-configured for connection with shafts. This complicates the production procedures for the individual modules, which must therefore be differentiated, as well as the procedures for constructing the basins, which require the exact positioning of different modules or the modification of the available modules on site.

Another possible use of structural modular elements similar to those described above is the construction of underground soil retaining structures. The high percentage of empty space in the volume created by said structural elements enables vegetation to root in the soil contained in the elements themselves, passing through them.

Thus the object of present invention is a new improved modular or semi-module element for the construction of underground structures of basins for the management of rainwater or retaining soil.

The patent also concerns the module obtained by connecting two semi-modules and the modular system for the construction of underground structures.

The main object of the present invention is to obtain tanks with high stiffness thanks to the particular configuration of the pillars.

Another important object of the present invention is to simplify and expedite the procedures for constructing and installing underground structures, facilitating the preparation and installation of inspection shafts.

In one possible embodiment, the semi-modules used are in fact pre-configured for the possible connection with inspection shafts without requiring any additional and/or specific operation.

Thus the semi-modules can all be installed indifferently, while the shafts can then be installed on any of the semi-modules, according to the design requirements.

These and other direct and complementary objects are achieved by the new improved modular or semi-module element for the construction of underground structures of basins for the management of rainwater or for retaining soil.

The new semi-module comprises a substantially plane and polygonal base portion, preferably rectangular, from the base of which some internally hollow and particularly reinforced pillars rise as described and claimed below.

In one possible embodiment, at least one main hole configured and sized for coupling with the duct of an inspection shaft is made on said base. In this case, said pillars are distributed around said hole, to ensure sufficient load bearing capacity.

Said pillars comprise a first external wall, with a substantially truncated pyramidal shape and a polygonal and/or variously curvilinear base or in any case suitable to be stacked with other identical semi-modules.

The larger base of said pillars is joined to said base portion, while the opposite smaller base comprises means for the engagement with a counterposed smaller base of an identical, symmetrically superimposed semi-module.

Said pillars are hollow, that is, there is at least one cavity inside them.

Inside said at least one cavity of said pillars there are stiffening elements. For example, in a preferred embodiment, inside said at least one cavity there is an internal stiffening tubular wall, spaced from said external wall and having a substantially prismatic or truncated pyramidal shape substantially corresponding to said external wall. Said internal wall and said external wall are joined together, for example in correspondence with said smaller base of the pillars.

The particular configuration of said pillars and their distribution around said possible main hole, ensures the adequate structural function of the semi-module in question.

Said base portion is suitably shaped as a grid, so as to allow the passage of water.

Each semi-module is configured to be coupled with an identical and symmetrically superimposed semi-module. In particular, the connection means between the two semi-modules are located on said smaller bases of the pillars as noted.

The whole module obtained by joining two semi-modules will therefore have a substantially parallelepiped volume, for example cubic, where the opposite bases are formed by said base portions of the two semi-modules and spaced apart by said pillars.

The system for the construction of underground structures comprises a plurality of said semi-modules, coupled two by two to form a plurality of said modules, and also comprises closing grids, suitable to be positioned on said base portions of the semi-modules to close said internal cavities of the pillars and said possible main holes to create a walkable surface.

In particular and preferably, the system comprises a closing grid configured to be installed at the larger base of each pillar and possibly a closure grid configured to be installed at said main hole of each semi-module, with the exception of the holes to be used for the inspection shafts.

The system also preferably comprises lateral grids suited to be installed laterally with respect to said pillars.

The system also comprises connection means for coupling the grids on the modules and for coupling adjacent semi-modules.

By using semi-modules equipped with said central hole, it will be possible to obtain a system comprising a plurality of main holes distributed according to a grid pattern with rectangular mesh, at distances between 50 and 100 cm, with the advantage of facilitating the positioning and installation of inspection shafts, which can be installed using any of said main holes of the modules.

The characteristics of the new semi-module, the module and the system for the construction of structures will be better explained by the following description with reference to the drawings attached by way of a non-limiting example.

FIG. 1 shows a three-dimensional top view of a semi-module (100) equipped with a main hole (102), while

Figure 1:
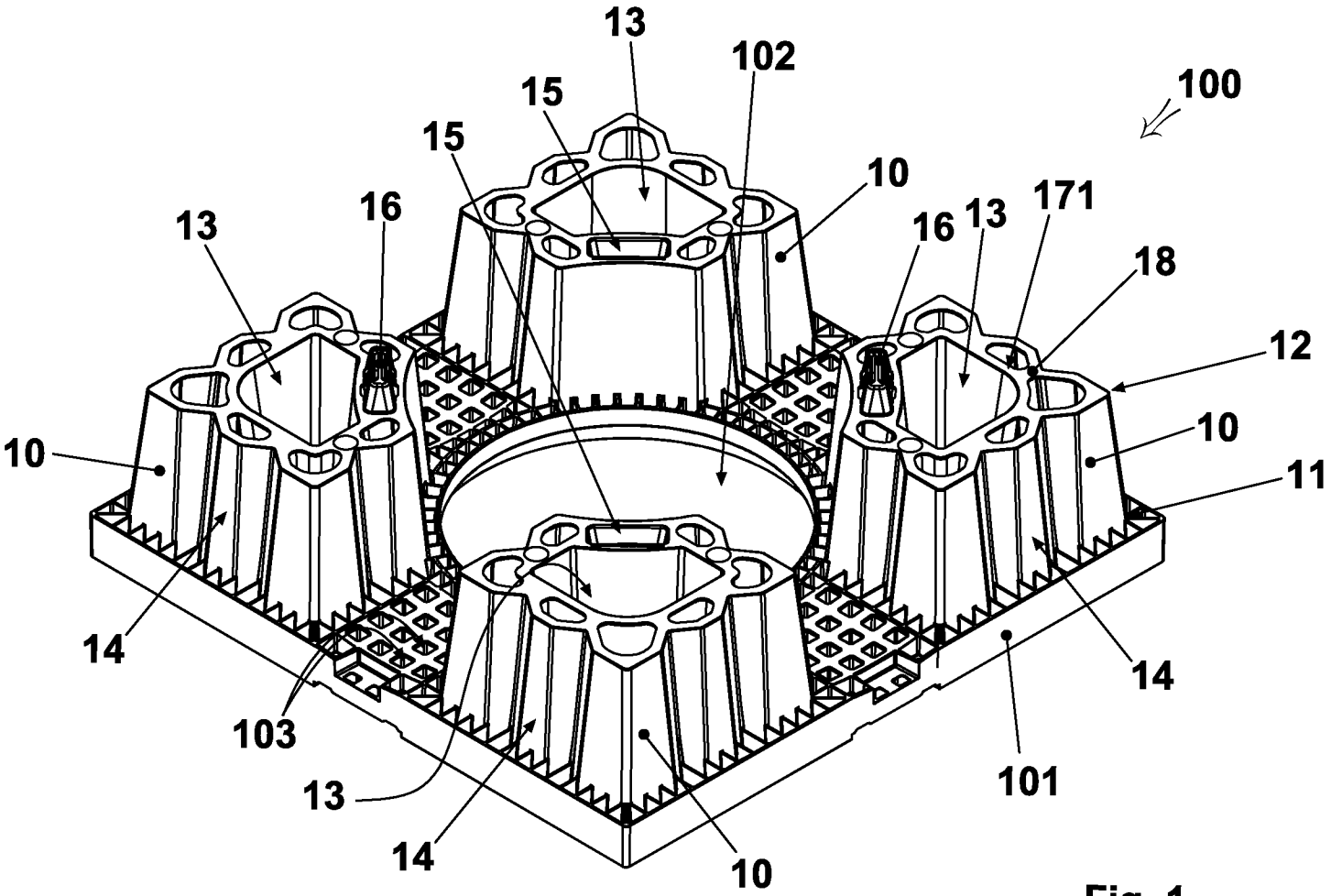
Figure 2:
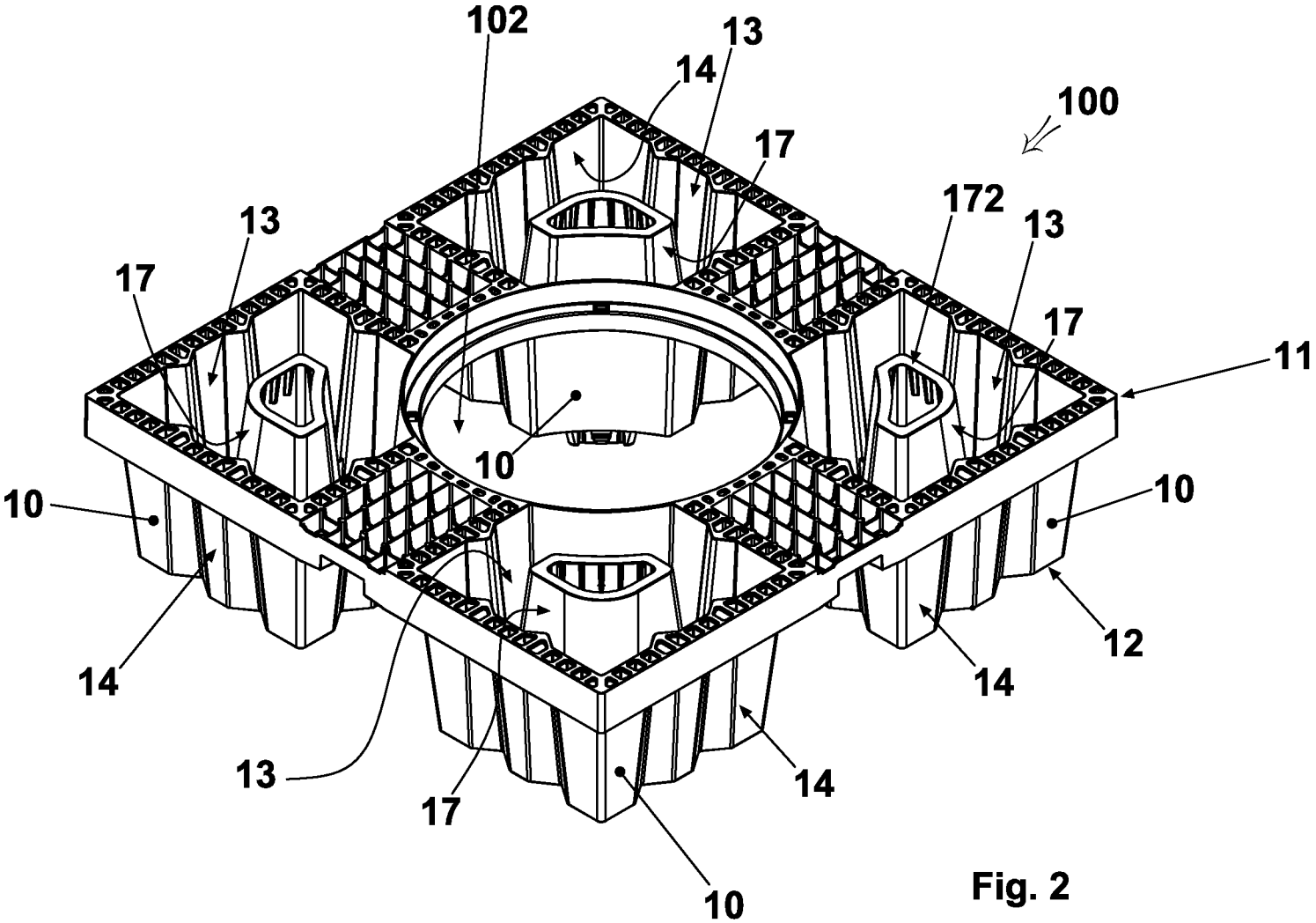
FIG. 2 shows a three-dimensional view from below of the semi-module (100) of FIG. 1.
Figure 3:
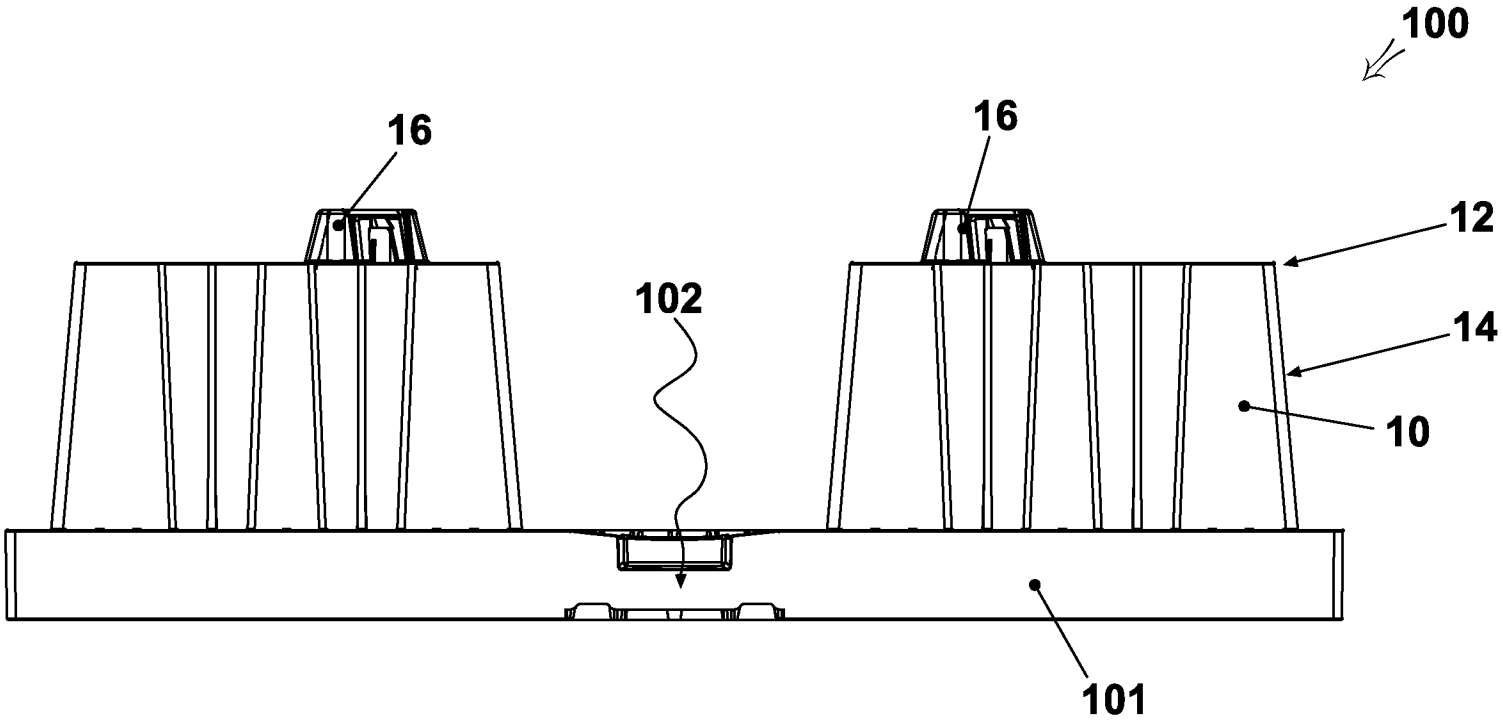
FIG. 3 shows a side view of the semi-module (100) of FIGS. 1 and 2.

This is an improved modular or semi-module element (100) for the construction of underground structures of basins for the management of rainwater or for retaining soil.

Said semi-module (100) comprises a substantially plane and rectangular base portion (101), grid shaped, that is, equipped with a plurality of holes/openings (103) for the passage of water.

From said base portion (101) some internally hollow and homogeneously distributed pillars (10) rise. For example, said semi-module (100) comprises four of said pillars (10) symmetrically arranged on said base portion (101).

Each of said pillars (10) comprises an external wall (14), with a substantially truncated pyramid shape or in any case suitable for stacking.

Said external wall (14) is preferably stiffened, for example ribbed or corrugated and preferably with a truncated pyramidal shape and a square base.

Figure 4:
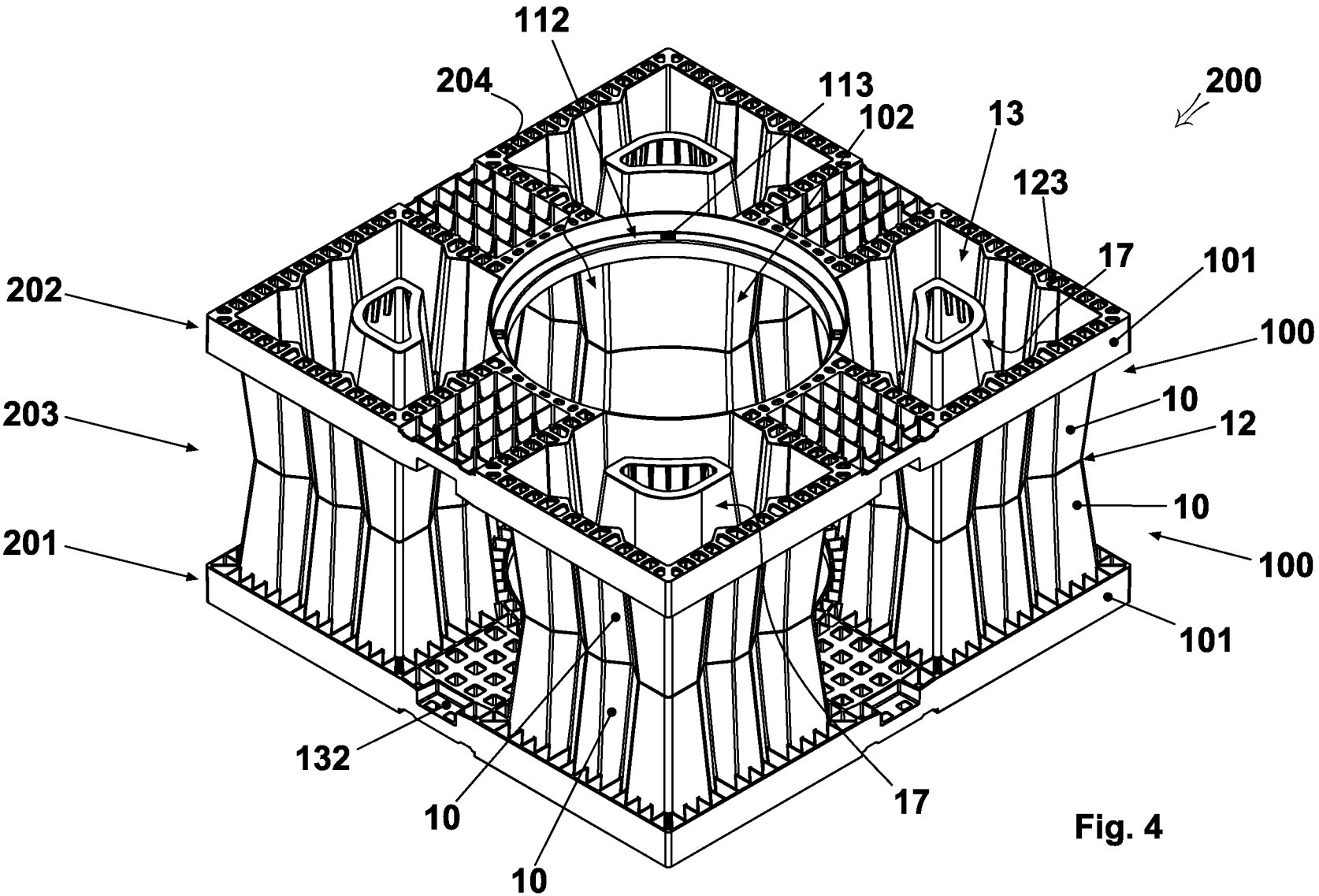
FIG. 4 shows a three-dimensional view of the module (200) made up of the superimposition and coupling of two semi-modules (100) provided with a main hole (102) and arranged symmetrically.

The larger base (11) of said pillars (10) is joined to said base portion (101), while the opposite smaller bases (12) comprise means for coupling (15, 16) with the counterposed smaller bases (12) of an identical semi-module (100), symmetrically superimposed as shown in FIG. 4.

For example, said smaller bases (12) of the pillars (10) comprise seats (15) and/or protrusions (16) arranged so that by symmetrically superimposing a second identical semi-module (100), said protrusions (16) of the first semi-module (100) engage in the seats (15) of the second semi-module (100) and vice versa.

As shown in the Figures, said pillars (10) are hollow, that is, there are cavities (13) inside them. In the preferred embodiment, said outer wall (14) of the pillars (10) is tubular and said pillars (10) are open at both of said ends so that said cavities (13) can be passed through.

Inside said cavities (13) of said pillars (10) there are stiffening elements. In particular, inside each of said pillars (10) there is an internal stiffening wall (17), spaced from said external wall (14) and of a substantially prismatic shape or even a truncated pyramidal shape substantially corresponding to said external wall (14).

Said external wall (14) and said internal wall (17) preferably have the same height, so that the ends of said external wall (14) and the ends (171, 172) of said internal wall (17) substantially correspond to said larger base (11) and smaller base (12) of said pillars (10).

Said internal wall (17) and said external wall (14) are joined together, for example in correspondence with said smaller base (12) of the pillar (10), by means of connecting partitions (18) which in any case enable the passage of water in the pillar (10) itself.

As shown in FIG. 4, each semi-module (100) is configured to be coupled with an identical semi-module (100) and symmetrically superimposed so that the respective smaller bases (12) of the pillars (10) are counterposed and joined together.

The whole module (200) obtained by joining two semi-modules (100) will therefore have a substantially parallelepiped shape, for example cubic, comprising two opposite plane bases (201, 202), made up of said base portions (101) of the two semi-modules (100) and spaced apart by pillars (203), each in turn made up by the coupling of two pillars (10) of said semi-modules (100).

In a possible alternative embodiment represented in FIGS. 1 to 4, a main hole (102), preferably central for example, is made on said base portion (101) of said semi-module (100). Said main hole (102) is not necessarily present on all the semi-modules (100).

Said main hole (102) is configured and sized to be coupled with the duct of an inspection shaft.

Thus the pillars (10) arise, as previously described, from said base portion (101) and are distributed around said main hole (102). For example, said semi-module (100) comprises four of said pillars (10) symmetrically arranged around said central main hole (102).

In the event that said main hole (102) is present, said outer wall (14) of the pillars (10) has a modified shape according to the presence of the main hole (102) itself and in particular it has a preferably truncated pyramidal shape with a 5-sided polygonal base with four straight sides orthogonal to each other and a fifth inclined side, straight or curved, closer to said main central hole (102).

The whole module (200) obtained by joining two semi-modules (100) will therefore be equipped with a through channel (204) between said opposite plane bases (201, 202), made of said main holes (102) made on said base portions (101) of the two semi-modules (100).

The system for the construction of underground basins therefore comprises a plurality of said semi-modules (100), coupled two by two to form a plurality of said modules (2000) and also comprises closure grids (110, 120, 130) suited to be positioned above and laterally to the modules (2000) to create parallelepiped structures with walkable surfaces as well as with structural cavities through which the loads can be appropriately distributed.

Figure 5:
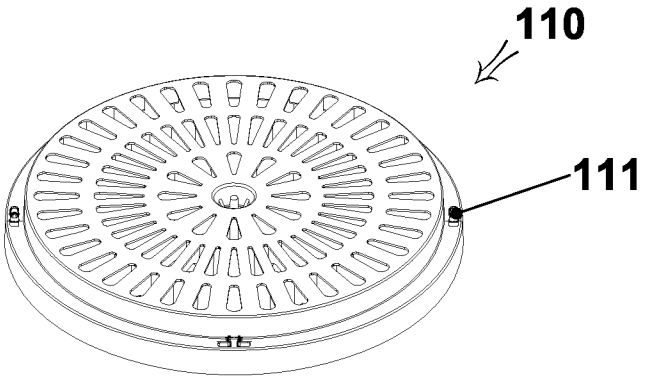
FIG. 5 shows a grid (110) for closing a hole (102) made on the base portion (101) of said semi-module (100).
Figure 7:
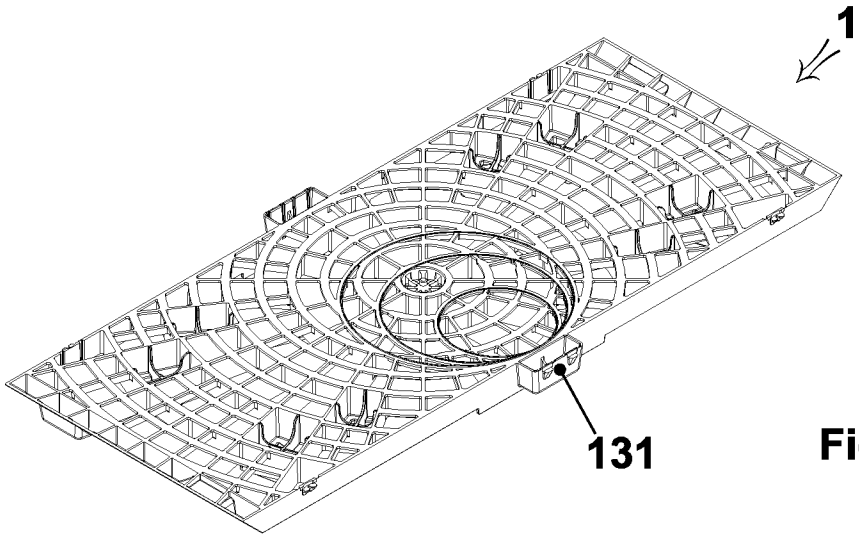
FIG. 7 shows a lateral grid (130) configured to be constrained to the semi-module (100) laterally to the pillars (10).

As shown in FIG. 5, the system comprises first closure grids (110) configured to be installed on said possible main hole (102) of the semi-modules (100). Said first closure grids (110) have, for example, a substantially circular shape, corresponding to the shape and dimensions of the main hole (102), and also comprise coupling means (111) to couple them to the edge (112) of the hole (102), where corresponding coupling means (113) will also be present.

Figure 6:
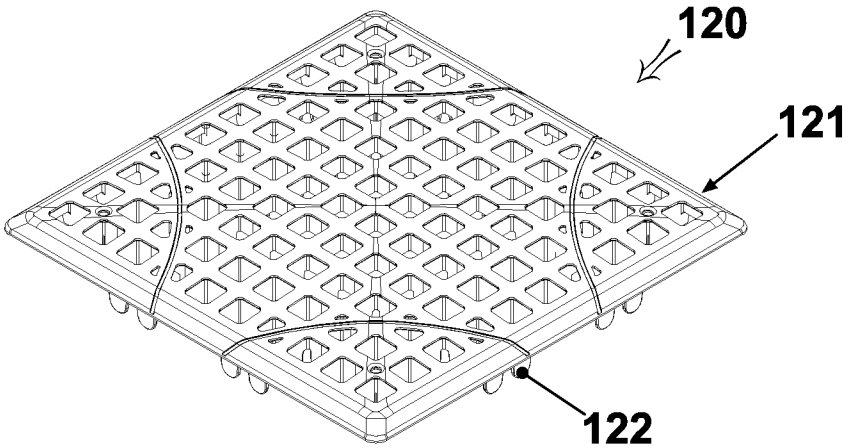
FIG. 6 shows a grid (120) for closing the cavities (13) which open on said base portion (101) of the semi-module (100) in correspondence with the larger bases (11) of the pillars (10).

As shown in FIG. 6, the system comprises second closure grids (120) configured to be installed on said cavities (13) on the side of said base portions (101) of said semi-modules (1000).

For example, said second closure grids (120) have a shape corresponding to said larger base (11) of the pillars (10). To optimize the production of the pieces and the installation procedures, said second closure grid (120) is expected to have a rectangular shape, with selectively detachable corners (121), in order to be used on both the semi-module (100) without a main hole (102), having pillars (10) with a quadrangular base, and on the semi-module (100) equipped with a main hole (102), having pillars (10) with a pentagonal base.

Said second closure grids (120) also comprise coupling means (122) to corresponding coupling means (123) present on the edge of said cavities (13).

The system also preferably comprises third lateral closure grids (130) suited to be installed laterally with respect to said pillars (10) also equipped with coupling means (131) to corresponding coupling means (132) present on said semi-modules (100).

The system also comprises connection means for coupling the grids on the modules and for coupling between semi-modules (100) and adjacent modules (200) not shown in the Figures.

Therefore, with reference to the preceding description and the attached drawings the following claims are made.

The invention claimed is:

1. A modular element or semi-module (100) for making underground structures for basins designed to manage meteoric waters or underground structures for retaining soil, comprising:

a planar base portion (101); and a plurality of pillars (10) rising from said base portion (101), said plurality of pillars (10) being connected to said base portion (101) by a larger base (11);

wherein each of said pillars (10) is hollow and each of said pillars (10) comprises a first external wall (14) defining an internal cavity (13), wherein said first external wall (14) is tubular and defines said internal cavity (13), wherein, inside said internal cavity (13) in each of said pillars, there is a stiffening tubular internal wall (17) which is spaced from said external wall (14) and has a prismatic shape or a shape corresponding to that of said external wall (14), said stiffening tubular internal wall (17) being connected to said external wall (14) by a smaller pillar base (12) opposite said larger base (11), wherein said external wall (14) and said internal wall (17) have a same height, and wherein said internal wall (17) and said external wall (14) are joined together by connecting partitions (18) configured to allow water to flow therethrough.

2. The modular element or semi-module (100) according to claim 1, wherein said first external wall (14) is shaped as a truncated pyramid or has a shape suitable for stacking said modular element or semi-module with other identical modular elements or semi-modules (100).

3. The modular element or semi-module (100) according to claim 1, wherein said first external wall (14) is ribbed or undulated.

4. The modular element or semi-module (100) according to claim 1, wherein the smaller base of said pillars (10) comprises engagement means (15, 16) to engage an opposite smaller base (12) of an identical, symmetrically stacked modular element or semi-module (100).

5. The modular element or semi-module (100) according to claim 4, wherein on said base portion (101) there is a main hole (102) configured and sized so that it can be coupled with a duct of an inspection shaft, and wherein said pillars (10) are distributed around said main hole (102).

6. The modular element or semi-module (100) according to claim 5, wherein said main hole (102) is in a central position on said base portion (101), and wherein said pillars (10) are a plurality of distributed symmetrically around said main hole (102).

7. A module (200) for making underground structures of underground basins for management of meteoric waters or for retaining soil, comprising:

two semi-modules (100) according to claim 1, wherein said two semi-modules (100) are arranged symmetrically so that smaller bases (12) of said one or more pillars (10) are opposite to each other and joined together.

8. A system of underground structures of underground basins for management of meteoric waters or for retaining soil, comprising:

a plurality of semi-modules (100) according to claim 5, coupled in pairs so as to form a plurality of said modules (200) arranged symmetrically so that smaller bases (12) of said pillars (10) are opposite to each other and joined together.

9. The system according to claim 8, wherein said main holes (102) of said semi-modules are distributed on said system in a grid pattern with rectangular meshes, at distances included between 50 and 100 cm.

10. The system according to claim 9, further comprising first grids (110) configured to be installed so as to close said main holes (102) of the semi-modules (100), and coupling means (111, 113) for coupling said first grids (110) with said semi-modules (100).

11. The system according to claim 8, further comprising second grids (120) configured to be installed so as to close said cavities (13) on a side where said base portions (101) of said semi-modules (100) are located, and coupling means (122, 123) for coupling said second grids (120) with said semi-modules (100).

12. The system according to claim 11, wherein a shape of said second grids (120) corresponds to a shape of said larger base (11) of said pillars (10) after removal of one or more selectively detachable corners (121).

* * * * *